US006988436B2

(12) United States Patent
Kawai

(10) Patent No.: US 6,988,436 B2
(45) Date of Patent: Jan. 24, 2006

(54) TURRET PUNCH PRESS

(75) Inventor: Hiroshi Kawai, Kani (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 7 days.

(21) Appl. No.: 09/955,334

(22) Filed: Sep. 19, 2001

(65) Prior Publication Data

US 2002/0038589 A1 Apr. 4, 2002

(30) Foreign Application Priority Data

Oct. 4, 2000 (JP) ..... 2000-304346

(51) Int. Cl.

| | |
|---|---|
| ***B21D 28/02*** | (2006.01) |
| ***B21D 28/36*** | (2006.01) |
| ***B21D 45/00*** | (2006.01) |
| ***B26D 7/18*** | (2006.01) |

(52) U.S. Cl. ..... 83/157; 83/164; 83/165; 83/552; 83/559

(58) Field of Classification Search ..... 83/164–166, 83/552, 102, 104, 105, 106, 147, 157, 162, 83/163, 167, 559–562

See application file for complete search history.

(56) References Cited

U.S. PATENT DOCUMENTS

| | | | | |
|---|---|---|---|---|
| 1,448,069 A | * | 3/1923 | Hudson et al. | 12/48 |
| 3,685,380 A | * | 8/1972 | Daniels | 83/552 |
| 3,777,601 A | * | 12/1973 | Strandell | 83/160 |
| 3,839,935 A | * | 10/1974 | Daniels | 83/165 X |
| 3,961,549 A | * | 6/1976 | Smith | 83/552 |
| 4,085,639 A | * | 4/1978 | Marconi | 83/552 X |
| 4,250,785 A | * | 2/1981 | Morishita et al. | 83/552 |
| 4,787,282 A | * | 11/1988 | Okachi et al. | 83/552 X |
| 4,986,153 A | * | 1/1991 | Matrak et al. | 83/552 X |
| 5,168,610 A | * | 12/1992 | Ichimura et al. | 83/552 X |
| 5,350,347 A | * | 9/1994 | Fujiwara et al. | 83/552 X |

FOREIGN PATENT DOCUMENTS

| | | | |
|---|---|---|---|
| JP | 2-224828 | * | 9/1990 |
| JP | 3-133527 | * | 6/1991 |
| JP | 4-43416 | | 4/1992 |
| JP | 5-65433 | | 8/1993 |

* cited by examiner

*Primary Examiner*—Clark F. Dexter
(74) *Attorney, Agent, or Firm*—Westerman, Hattori, Daniels & Adrian, LLP

(57) ABSTRACT

The object of the present invention is to provide a turret punch press capable of discharging easily the small article work sheet cut off from the material work sheet, without employing a subhead separately from the punch driving mechanism. The punch press comprises a work sheet outlet 12 for discharging small article work sheet cut off from the material work sheet in the punch processing, employed in the lower turret 4. Moreover, a chute 13 connected to the work sheet outlet 12 is employed in a main body frame 1.

4 Claims, 4 Drawing Sheets

TURRET PUNCH PRESS

FIELD OF THE INVENTION

The present invention relates to a turret punch press and especially to the discharging structure of a small article work sheet after the cutting off processing.

BACKGROUND OF THE INVENTION

When cutting off a product work sheet from a material work sheet in a continuous hole opening process by a turret punch press, a part of the outer circumference is left uncut and connected to the material work sheet. The connected part is cut off thereafter. By leaving a connected part likewise, in the punch processing, the work sheet feeding by a work holder which carries out feeding operation by gripping the edge of the material work sheet, can be carried out.

For example, the cutting off operation of the connected part is carried out by a subhead of which is a punch processing head exclusive for the cutting off operation, employed at a position apart from the turret. The discharging of the cut off product work sheet is generally carried out by a suction typed unloader. Since the small article cannot be sucked, a work chute to be mentioned in the following is to be used. The work chute is leading to the outside of the machine from the opening near the subhead in the upper surface of the table. The opening is closed during the processing.

Since the subhead is required to be located at a position apart from the turret, the subhead is to be located greatly off set from the main punch head provided in the designated position over the turret. As a result, it is difficult to obtain processing precision, the cutting off processing of the connected part of the product work sheet and the material work sheet cannot be carried out neatly, thus there are cases in which the quality of the product is influenced. Moreover, since the subhead is provided with the punch driving mechanism, by providing a subhead, the structure of the turret punch press becomes complicated and the cost is increased.

The object of the present invention is to provide a turret punch press capable of solving such problems, and capable of discharging easily the small article work sheet cut off from the material work sheet, without employing a separate subhead from a punch driving mechanism.

SUMMARY OF THE INVENTION

The turret punch press according to the present invention comprises an upper turret holding a plurality of punch tools, a lower turret holding in a plurality the die tools corresponding to the punch tools, and a punch driving mechanism for driving the punch tool of the upper turret. In the lower turret, the work sheet outlet for discharging the small article work sheet cut off from the material work sheet in the punch processing is employed.

According to this composition, since the work sheet outlet is provided in the lower turret, even when the cutting off processing is carried out with the punch tool of the upper turret by the punch driving mechanism, the cut off small article work sheet is discharged from the work sheet outlet of the lower turret in that form. Therefore, there is no need to employ a driving mechanism of the subhead or the like exclusive for the cutting off, apart from the punch driving mechanism. As a result, the structure of the punch press is simplified and the cost can be reduced.

In the present invention, a chute connected to the work sheet outlet of the lower turret can be provided in the main body frame supporting the lower turret. If constructed likewise, the small article work sheet cut off from the material work sheet can be discharged easily to the outside of the machine by being slid over the chute.

Moreover, in the present invention, an opening and closing plate freely opening and closing to cover the work sheet outlet can be provided in the lower turret so that the upper surface level in the closed state is to be approximately equal to the upper surface level of the lower turret. By providing the opening and closing plate to cover the work sheet outlet during the processing, the work sheet feeding or the punch processing can be carried out without being interrupted by the work sheet outlet. The opening and closing plate can be used just as a cover, or can be used as a chute, to discharge the small article work sheet being slid in self-control. Further, the upper surface level of the lower turret mentioned here is the upper surface of the table when employing a table in the lower turret.

DETAILED DESCRIPTION OF THE PREFERRED EMBODIMENTS

Figure 1:
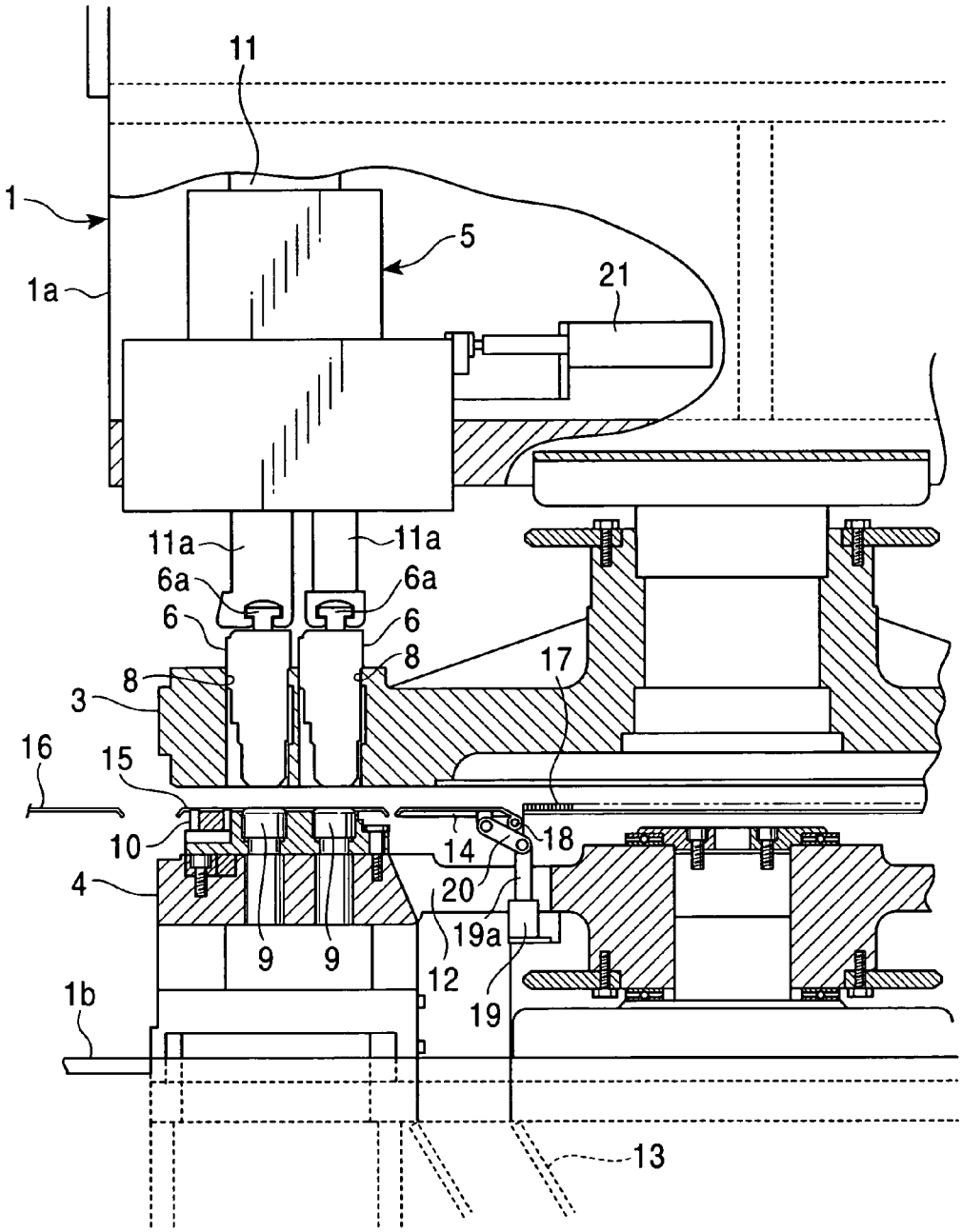
FIG. 1 is a longitudinal sectional view showing the processing unit of the turret punch press according to the embodiment of the present invention.
Figure 2:
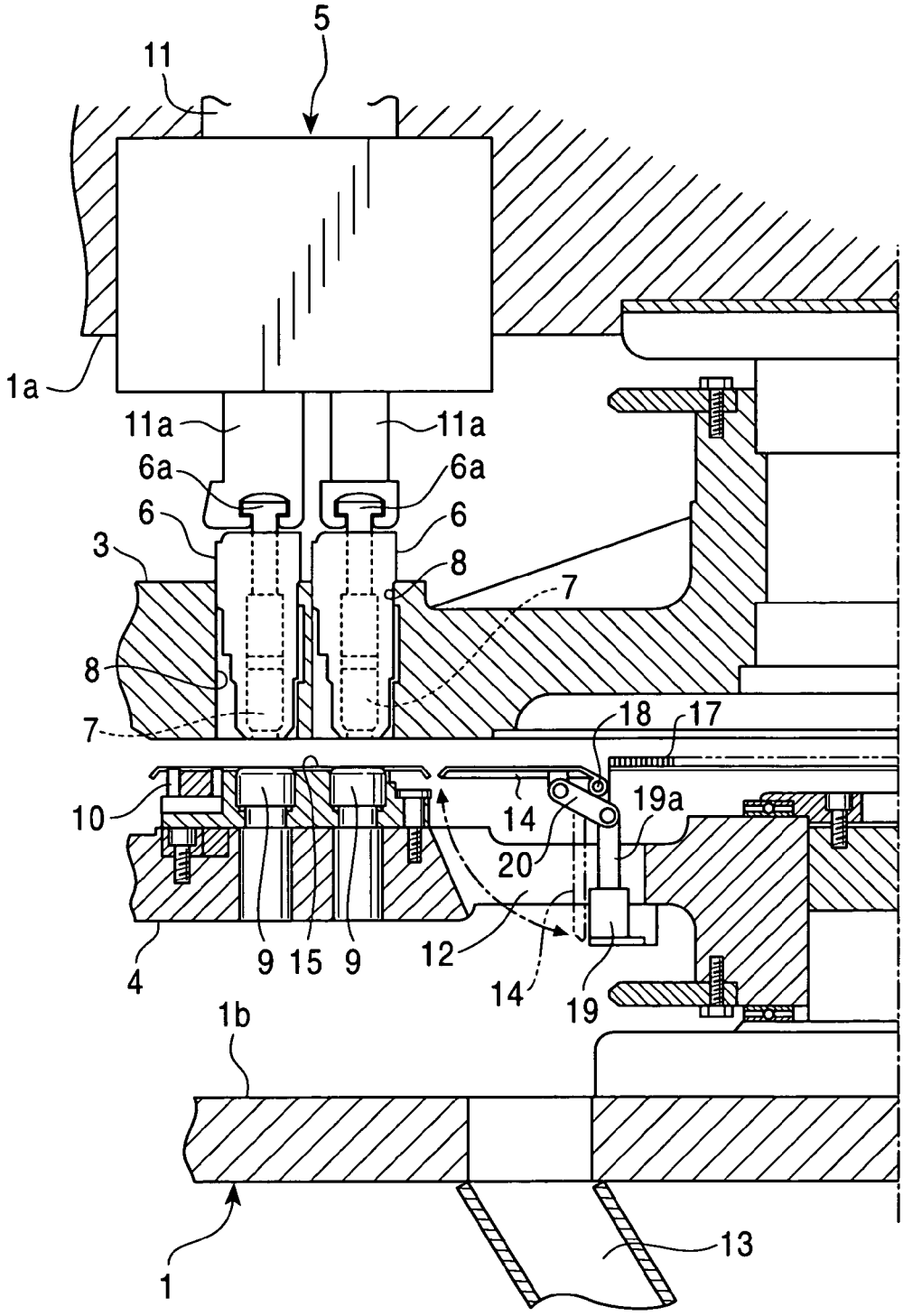
FIG. 2 is an enlarged longitudinal sectional view showing the relevant part of the processing unit of the same.

One embodiment of the present invention will now be described in reference to FIG. 1 through FIG. 4.

A turret punch press comprises an upper turret 3 and a lower turret 4 of the same shaft employed rotatable in between an upper frame section 1*a* and a lower frame section 1*b* of a main body frame 1, and a punch driving mechanism 5.

The upper turret 3 and the lower turret 4 are selected and rotated by the selecting driving mechanism (not shown in the drawings).

Figure 3:
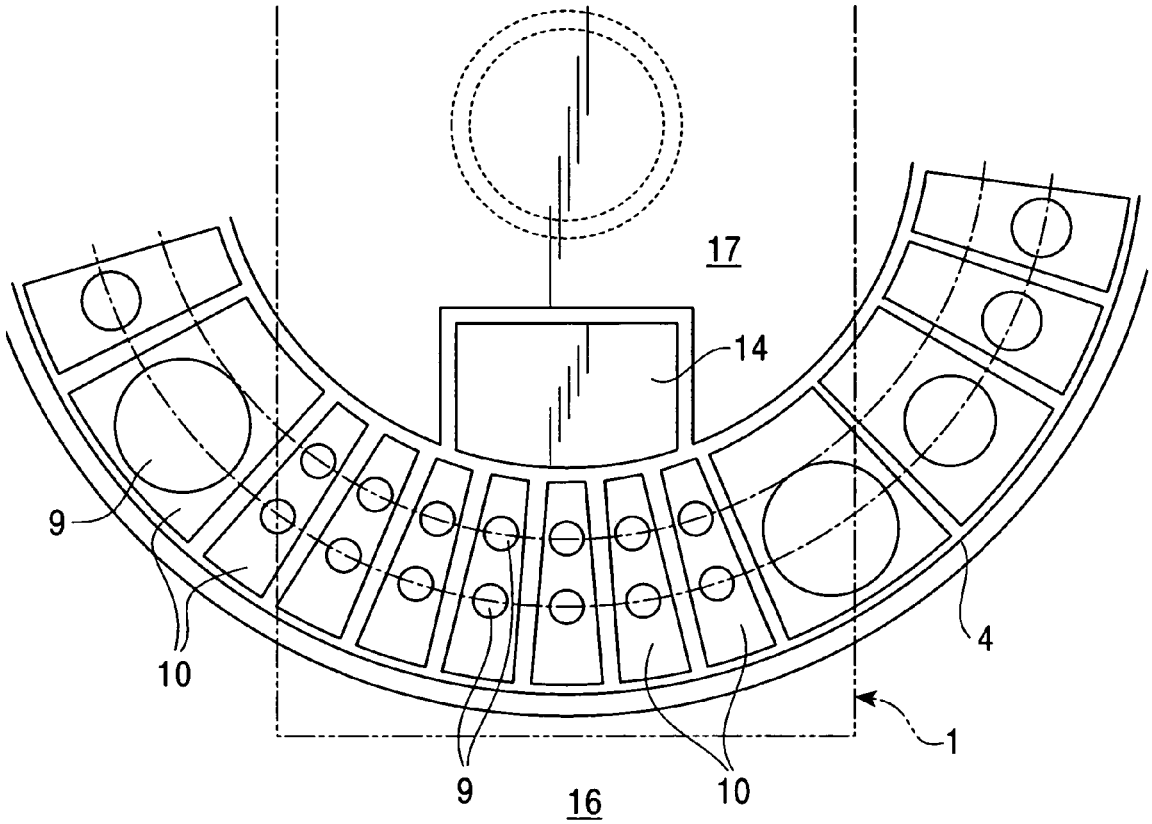
FIG. 3 is a plan view showing a part of the lower turret in the processing unit of the same.

A plurality of punch storing holes 8 which hold the punch tool 6 freely elevating and descending, are employed by being arranged on the circumference of the upper turret 3. In the example shown in the drawing, the punch storing holes 8 are employed in two lines inside and outside. The punch tool 6 includes a punch cutting blade 7 (refer to FIG. 2) employed within the punch tool 6. The lower turret 4 includes a die tool 9 corresponding to the punch tool 6 of the upper turret 3, held in a plurality via a die holder 10, and a plurality of die holders 10 are employed by being arranged on the circumference as shown in FIG. 3. Referring to FIG. 1, the punch driving mechanism 5 drives the punch tool 6 of the upper turret 3 by elevating and descending a ram 11. The ram 11 is connected to the drive source (not shown in the drawings) of the motor or the hydraulic cylinder or the like. In this example, two individual rams 11*a* corresponding to the punch tool 6 in two rows inside and outside, are employed. Out of these two rams 11*a*, only the one selected by a ram selector 21 is driven to be elevated and descended by the elevating and descending operation of the ram 11.

The punch tool 6 includes a letter "T" shaped head 6*a* in its upper edge, and is supported not to fall off from the upper turret 3 by the head 6*a* being guided by a ring shaped guide plate (not shown in the drawings). In the place of the guide plate, a spring mechanism (not shown in the drawings) which supports the punch tool 6 at an elevating position, can be employed. The punch tool 6 of which has reached the plane position (punch position) where the ram 11 is employed, is to be connected to the ram 11 by the head 6*a* engaging with the letter "T" shaped groove at the lower edge of the individual ram 11*a*.

A work sheet outlet 12 for discharging the small article work sheet cut off from the material work sheet in the punch processing, is employed in the inner diameter side of the employed section of the designated die holder 10 within the lower turret 4. A chute 13 which is connected to the work sheet outlet 12, is employed in the lower frame section 1*b* of the main body frame 1 supporting the lower turret 4. Moreover, a freely opening and closing plate 14 which covers the work sheet outlet 12, is employed in the lower turret 4. The height of the opening and closing plate 14 is set so that the upper surface level in the closed state equals approximately to the upper surface level of the lower turret 4. Specifically, the upper surface level of the opening and closing plate 14 in the closed state is set to be approximately equal to a table 17 employed in the upper surface of the lower turret 4 or a table 15 employed in the upper surface of the die holder 10. The tables 15, 17 are employed at the same level as to the upper surface level of a table 16 employed in the front of the lower turret 4.

The inner edge section of the opening and closing plate 14 which is located in the inner diameter side of the lower turret 4, is supported freely opening and closing in the opening edge of the work sheet outlet 12 via a supporting shaft 18. Moreover, the opening and closing plate 14 is connected to an opening and closing drive source 19. The opening and closing drive source 19 comprises the fluid pressured cylinder, and the intermediate part of the lower surface of the opening and closing plate 14 is connected to a piston rod 19*a* via a link 20. The opening and closing plate 14 carries out opening and closing operation by being driven to elevate and descend by the opening and closing drive source 19 comprised of the fluid pressured cylinder.

In the front of the lower turret 4, a work sheet feeding mechanism (not shown in the drawings) for feeding to front and back, and to left and right, by gripping the material work sheet transported onto the table 16, is employed. The work sheet feeding mechanism feeds to the punch position, the parts to be processed of the material work sheet.

The operation of the structure illustrated above will now be described. The upper turret 3 and the lower turret 4 are selected and rotated in synchronism, and the requested punch tool 6 and the corresponding die tool 9 are selected to the punch position. Moreover, the selecting of the individual ram 11*a* is carried out by a ram selector 21. On the other hand, the feeding of the material work sheet is carried out by the work sheet feeding mechanism, and the part to be processed of the material work sheet is to be positioned on the selected die tool 9. Under this condition, the ram 11 of the punch driving mechanism 5 are driven to elevate and descend and the punch processing is carried out.

When carrying out the processing to cut off the product work sheet from the material work sheet, a continuous punch processing is carried out by shifting the punch position accordingly by the feeding of the material work sheet. Then, the punch processing is carried out to the entire outer circumference of the product work sheet. This punch processing can be processed to leave a part of the outer circumference of the product work sheet as a connected section and to cut off the connected part by the punch processing later on, or can be a punch processing continued to the entire circumference.

Figure 4A:
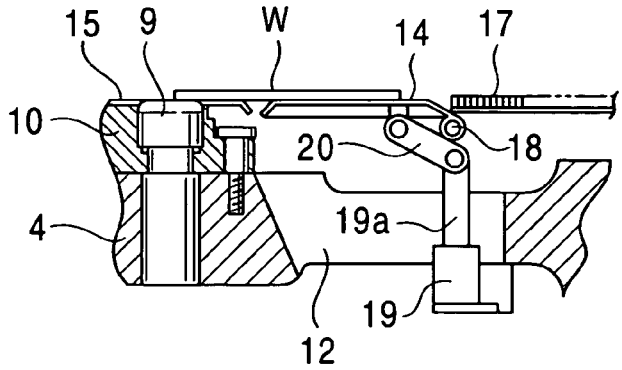
FIGS. 4A–4C are views useful for explaining the discharging operation of the small article work sheet of the punch press.

In the processing operation, when the product work sheet to be cut off from the material work sheet is a small article, the die tool 9 of the lower turret 4 wherein the work sheet outlet 12 is located in the inner diameter side, and the punch tool 6 of the corresponding upper turret 3 are used, and a small article work sheet W is cut off from the material work sheet by punch processing as shown in FIG. 4A. The work sheet outlet 12 of the lower turret 4 is covered by the opening and closing plate 14 during the punch processing. Further, the upper surface level of the opening and closing plate 14 is set to equal approximately with the upper surface level of the table 15 of the upper surface of the die holder 10 and the table 17 of the inner diameter side of the lower turret 4. Therefore, the work sheet outlet 12 does not interfere with the feeding of the material work sheet and the transferring of the work sheet can be carried out smoothly.

Figure 4B:
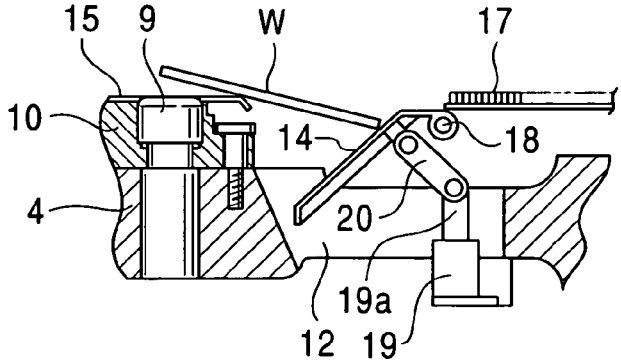
Figure 4C:
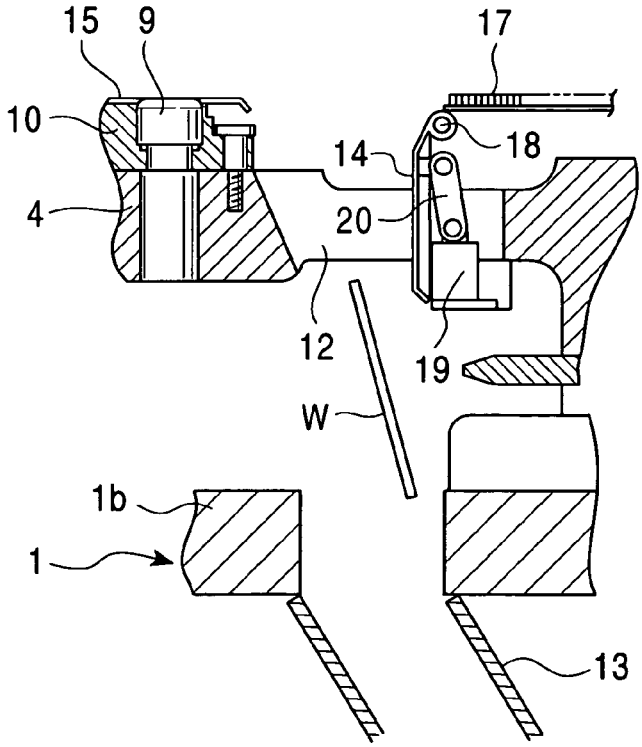

When the small article work sheet W is cut off from the material work sheet, as shown in FIGS. 4B and 4C, the opening and closing drive source 19 drives to the descending side, the opening and closing plate 14 becomes into a released state, facing perpendicularly downward, and the work sheet outlet 12 opens. As a result, the small article work sheet W falls freely from the work sheet outlet 12 of the lower turret 4 to the chute 13, slides through the chute 13, and is discharged to the outside of the machine.

Likewise, in the turret punch press of the embodiment according to the present invention, the work sheet outlet 12 for discharging the small article work sheet W is employed in the lower turret 4. Therefore, without employing a sub-head separately from the punch driving mechanism 5, the small article work sheet W can be cut off from the material work sheet only by the punch driving mechanism 5, and can easily be discharged from the work sheet outlet 12 to outside of the punch position.

The turret punch press according to the present invention comprises an upper turret for supporting a plurality of punch tools, a lower turret for supporting a plurality of die tools corresponding to the punch tool, and a punch driving mechanism for driving the punch tool of the upper turret. Since a work sheet outlet is employed in the lower turret to discharge the small article work sheet cut off from the material work sheet in the punch processing, without employing a processing head exclusive for the cutting off processing, the small article work sheet can be cut off from the material work sheet only by the punch driving mechanism, and easily discharged from the work sheet outlet.

When a chute connected to the work sheet outlet of the lower turret is employed in the main body frame supporting the lower turret, the small article work sheet cut off from the material work sheet can be discharged to the outside of the machine easily by self-control.

When an opening and closing plate for covering the work sheet outlet is employed freely opening and closing to the lower part in the lower turret, the work sheet feeding or the punch processing can be prevented from being interrupted by the work sheet outlet. Moreover, the opening and closing plate can be used as a chute and the small article work sheet can be discharged by being slid.

What is claimed is:

1. A turret punch press comprising:

an upper turret supporting a plurality of punch tools;

a lower turret supporting a plurality of die tools corresponding to the punch tools, the lower turret having a work sheet outlet positioned inside the lower turret; and a punch driving mechanism operatively connected to the punch tools for driving the punch tools of the upper turret;

wherein a small article work sheet is cut off from a material work sheet which has been fed into the turret punch press in a punch process so that the small article work sheet is located above the work sheet outlet in the lower turret and then is discharged through the work sheet outlet;

wherein an opening and closing plate, freely opening and closing, for covering said work sheet outlet, is employed in said lower turret so that an upper surface of the opening and closing plate, when said plate is closed, is approximately even in height with an upper surface of the lower turret.

2. The turret punch press according to claim 1, wherein a chute is connected to the work sheet outlet of said lower turret.

3. A turret punch press comprising:

a main body frame supporting an upper turret and a lower turret;

the upper turret supporting a plurality of punch tools;

the lower turret, positioned below the upper turret, supporting a plurality of die tools corresponding to the punch tools, the lower turret having a work sheet outlet positioned inside the lower turret between the plurality of die tools and the center of the lower turret; and a punch driving mechanism operatively connected to the punch tools for driving the punch tools of the upper turret;

wherein a small article work sheet is cut off from a material work sheet which has been fed into the turret punch press in a punch process so that the small article work sheet is located above the work sheet outlet in the lower turret and then is discharged through the work sheet outlet;

wherein an opening and closing plate, connected to an opening and closing drive source, covers an upper opening of the work sheet outlet; and wherein an upper surface of the opening and closing plate, when said plate is closed, is approximately even in height with an upper surface of the lower turret.

4. The turret punch press according to claim 3, wherein a chute is connected to the work sheet of said lower turret.

* * * * *